US008827872B2

(12) United States Patent
Tamari et al.

(10) Patent No.: US 8,827,872 B2
(45) Date of Patent: Sep. 9, 2014

(54) BICYCLE DEVICE HAVING MULTIPLE POSITIONS FOR CONNECTING A SEAT

(76) Inventors: Ran Tamari, Hod-Hasharon (IL); Herzel Frenkel, Ashdod (IL)

( * ) Notice: Subject to any disclaimer, the term of this patent is extended or adjusted under 35 U.S.C. 154(b) by 389 days.

(21) Appl. No.: 13/000,367

(22) PCT Filed: Jun. 24, 2009

(86) PCT No.: PCT/IL2009/000633

§ 371 (c)(1),
(2), (4) Date: Dec. 21, 2010

(87) PCT Pub. No.: WO2009/156996

PCT Pub. Date: Dec. 30, 2009

(65) Prior Publication Data

US 2011/0177919 A1 Jul. 21, 2011

Related U.S. Application Data

(60) Provisional application No. 61/075,342, filed on Jun. 25, 2008.

(51) Int. Cl.
*A63B 22/06* (2006.01)

(52) U.S. Cl.
USPC ..... 482/57; 482/51; 280/288.2

(58) Field of Classification Search
USPC ..... 482/51, 57–65; 280/282, 288.1, 287, 280/288.2
See application file for complete search history.

(56) References Cited

U.S. PATENT DOCUMENTS

| | | | | |
|---|---|---|---|---|
| 5,823,554 | A * | 10/1998 | Lau | 280/261 |
| 5,823,915 | A | 10/1998 | Chen | |
| 5,916,065 | A * | 6/1999 | McBride et al. | 482/57 |
| 6,497,426 | B2 * | 12/2002 | VanPelt | 280/287 |
| 6,527,290 | B1 * | 3/2003 | Black | 280/288.1 |
| 8,056,916 | B2 * | 11/2011 | Hudgin | 280/233 |
| 2005/0075222 | A1 | 4/2005 | Adley | |
| 2007/0099766 | A1 | 5/2007 | Pyles et al. | |

FOREIGN PATENT DOCUMENTS

WO PCT/IL2009/000633 1/2011

* cited by examiner

*Primary Examiner* — Glenn Richman
(74) *Attorney, Agent, or Firm* — Soroker-Agmon

(57) ABSTRACT

The subject matter discloses a bicycle device capable of functioning as an upright bicycle and a recumbent bicycle using one seat. The bicycle device according may comprise a seat, a body, a wheel operated by the user of the exercising device and a directing rod connecting the body and the seat. Such that movement of the directing rod allows positioning the seat in front position used for upright bicycle and rear position used for recumbent bicycle.

7 Claims, 5 Drawing Sheets

BICYCLE DEVICE HAVING MULTIPLE POSITIONS FOR CONNECTING A SEAT

This application claims priority from provisional patent application number 61/075,342 filed Jun. 25, 2008.

BACKGROUND OF THE INVENTION

1. Technical Field

The present disclosure relates to exercise equipments in general, and to a bicycle devices in particular.

2. Discussion of the Related Art

Various types of exercise equipment are used for aerobic exercise. For example, cross-country skiing exercise devices that simulate the gliding motion of cross-country skiing, elliptical machines, treadmills, bicycle and others. Some of these devices may cause injuries in case they are used solely for long durations. For example, extensive use of treadmills may cause jarring of the hip, knee, ankle and other joints.

When a gym subscriber exercises or plans an exercise program, he wishes to build up different muscles or on several groups of muscles. This may be achieved by working on different aerobic devices. For example, the biceps can be strengthened using the bicycle, and the gastronomies muscle is activated when using an elliptical device.

Two major types of bicycle are available in the market—upright stationary bicycle, in which the seat is positioned in substantially the same vertical line of the pedals, and recumbent stationary bicycle, such as commercially available Proform Cross Trainer 55, in which places the rider in laid-back reclining position. An alternative definition for recumbent bicycle is a bicycle in which a bench is positioned in substantially the same vertical line of the back wheel. Each bicycle device, the upright stationary device and the recumbent stationary bicycle, enable the user to regularly pedal and exercise aerobically.

It is thus required to provide a mechanism to enable a user of an exercising device to train in a variety of aerobic exercises.

SUMMARY OF THE PRESENT INVENTION

It is an object of the subject matter to disclose a bicycle device capable of functioning as an upright bicycle and a recumbent bicycle using one seat.

In some cases, the bicycle device comprises a seat, a body, a wheel operated by the user of the exercising device and a directing rod connecting the body and the seat. The result is enabling movement of the directing rod allows positioning the seat in front position used for upright bicycle and rear position used for recumbent bicycle.

In some cases, the seat is positioned substantially above the wheel when used as an upright bicycle and positioned substantially rearward to the wheel when used as a recumbent bicycle.

In some cases, wherein the movement of the directing rod is linear. In some cases, the bicycle device further comprises a track for moving the directing rod.

In some cases, wherein the movement of the directing rod is circular. In some cases, the directing rod comprises two or more parallel longitudinal arms, such that the seat is generally parallel to the ground when used as a recumbent bicycle without adjusting the angle between the seat and the directing rod. In some cases, the bicycle device comprising two or more joints connecting the two or more parallel longitudinal arms to the seat and to the body of the exercising device.

It is another object of the subject matter to disclose a bicycle device comprising a body, a wheel operated by the user of the exercising device, two or more bores into which seat mechanisms are inserted; at least one of the two or more bores is located substantially above the wheel such that a seat mechanism inserted thereto enables using the bicycle device as an upright bicycle device. The at least one of the two or more bores is located substantially rearward to the wheel such that a seat mechanism inserted thereto enables using the bicycle device as a recumbent bicycle device.

BRIEF DESCRIPTION OF THE DRAWINGS

Exemplary non-limited embodiments of the disclosed subject matter will be described, with reference to the following description of the embodiments, in conjunction with the figures. The figures are generally not shown to scale and any sizes are only meant to be exemplary and not necessarily limiting. Corresponding or like elements are designated by the same numerals or letters.

DETAILED DESCRIPTION OF THE PREFERRED EMBODIMENT

The technical problem dealt with in the disclosed subject matter is to enable a person to use one stationary exercising device as both upright bicycle and recumbent bicycle.

One technical solution suggested in the subject matter is a mechanism that enables movement of the stationary bicycle seat from an upright location, in which the seat is located substantially above the center of the pedals' course of movement, to a recumbent location, backwards to the center of the pedals' course of movement. The mechanism may comprise one or more elements for vertical or horizontal movement of the seat, such that the user can manually adjust the location of the seat as required. The location of the seat may alternatively be adjusted mechanically or electrically, using a control unit and an input device, receiving a command or input from the user and maneuvering the seat or the mechanism accordingly. In accordance with some exemplary embodiments of the subject matter, the mechanism moves the seat in a generally circular course of movement, to keep the distance between the seat and the pedals generally constant. Another solution for the technical problem disclosed above is a device having two or more bores into which a seat mechanism may be positioned. At least one of the bores enables the user to use the exercising device as an upright bicycle, while another bore enables the user to use the exercising device as a recumbent bicycle.

Figure 1A:
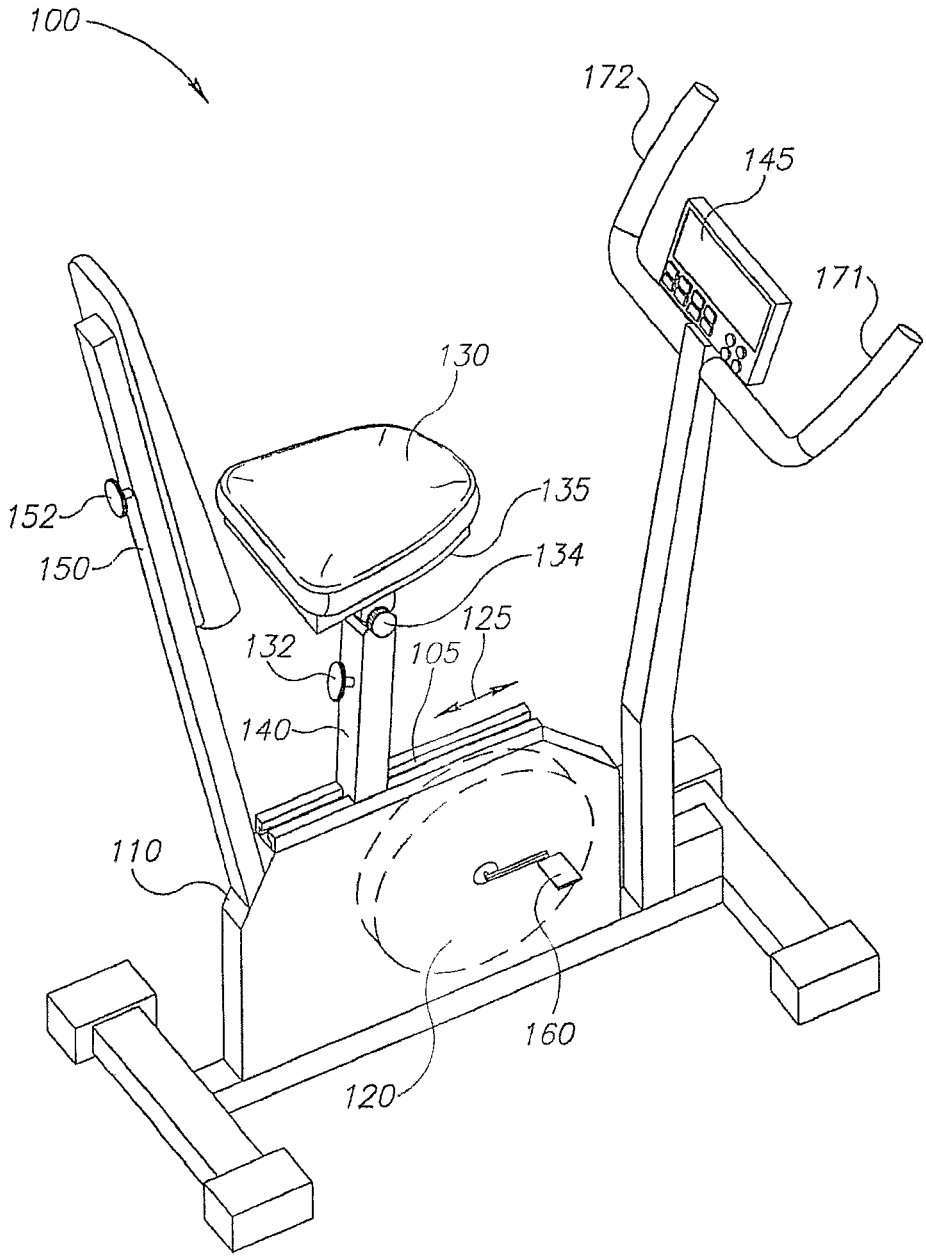
FIG. 1A schematically illustrates stationary bicycle enabled to operate as both upright and recumbent stationary bicycle using linear movement of the seat, in accordance with an exemplary embodiment of the disclosed subject matter.

FIG. 1A schematically illustrates a stationary bicycle 100 enabled to operate as both upright and recumbent stationary bicycle using linear movement of the seat, in accordance with an exemplary embodiment of the disclosed subject matter. Stationary bicycle 100 comprises a body 110 connected to a wheel 120. In accordance with some exemplary embodiments of the subject matter, a seat 130 is connected to a rigid base 135 connected to a directing rod 140. Directing rod 140 is connected on its distal end to the rigid base 135 and on its proximal end to the body 110 of the stationary bicycle 100, or to another element connected to body 110. Such another element may be an adapter, for adapting the height or angle of the seat 130. In some exemplary embodiments of the subject matter, the proximal end of directing rod 140 is preferably adjacent to the center of the course of movement of pedal 160 to maintain the distance between the seat 130 and pedal 160 substantially constant, in the various locations of the seat 130.

Directing rod 140 may be maneuvered by the user, or by a power-generating module (not shown), preferably controlled by a control unit 145. In accordance with some exemplary embodiments disclosed in FIG. 1A, the movement of the seat 130 is performed as a result of linear movement of the directing rod 140 on a track 105. The length of the track 105 may be in a range of 20-100 centimeters, such that to allow the user to be positioned rearward to the pedals. In such case, the proximal end of the directing rod 140 is connected to the track 105, in a manner that enables forward movement of the directing rod 140, towards handlebars 171, 172, and backwards, as shown by arrow 125. Hence, when the directing rod 140 is located substantially above the wheel 120, the stationary bicycle 100 operates as upright stationary bicycle. When directing rod is moved backwards, the seat 130 is relatively adjacent to backrest 150, and stationary bicycle 100 operates as a recumbent stationary bicycle. A first thumbscrew knob 152 may enable adjusting the height of the backrest 150 above body 110. The height of the seat 130 on the directing rod 140, or the angle between the seat 130 and the directing rod 140, may be adjusted using a second thumbscrew knob 132.

Figure 1B:
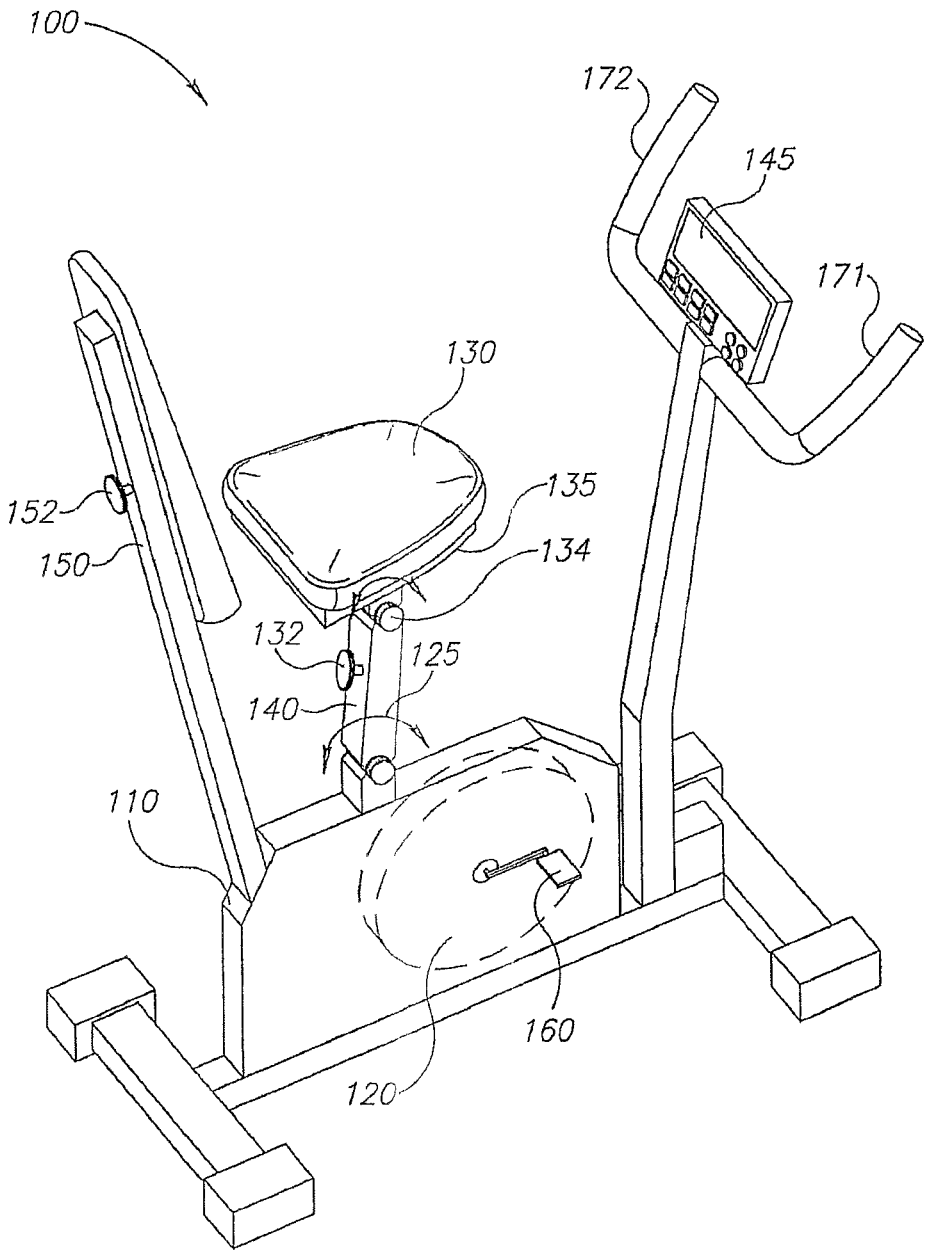
FIG. 1B schematically illustrates stationary bicycle enabled to operate as both upright and recumbent stationary bicycle using circular movement of the seat, in accordance with an exemplary embodiment of the disclosed subject matter.
Figures 2A, 2B, 2C:
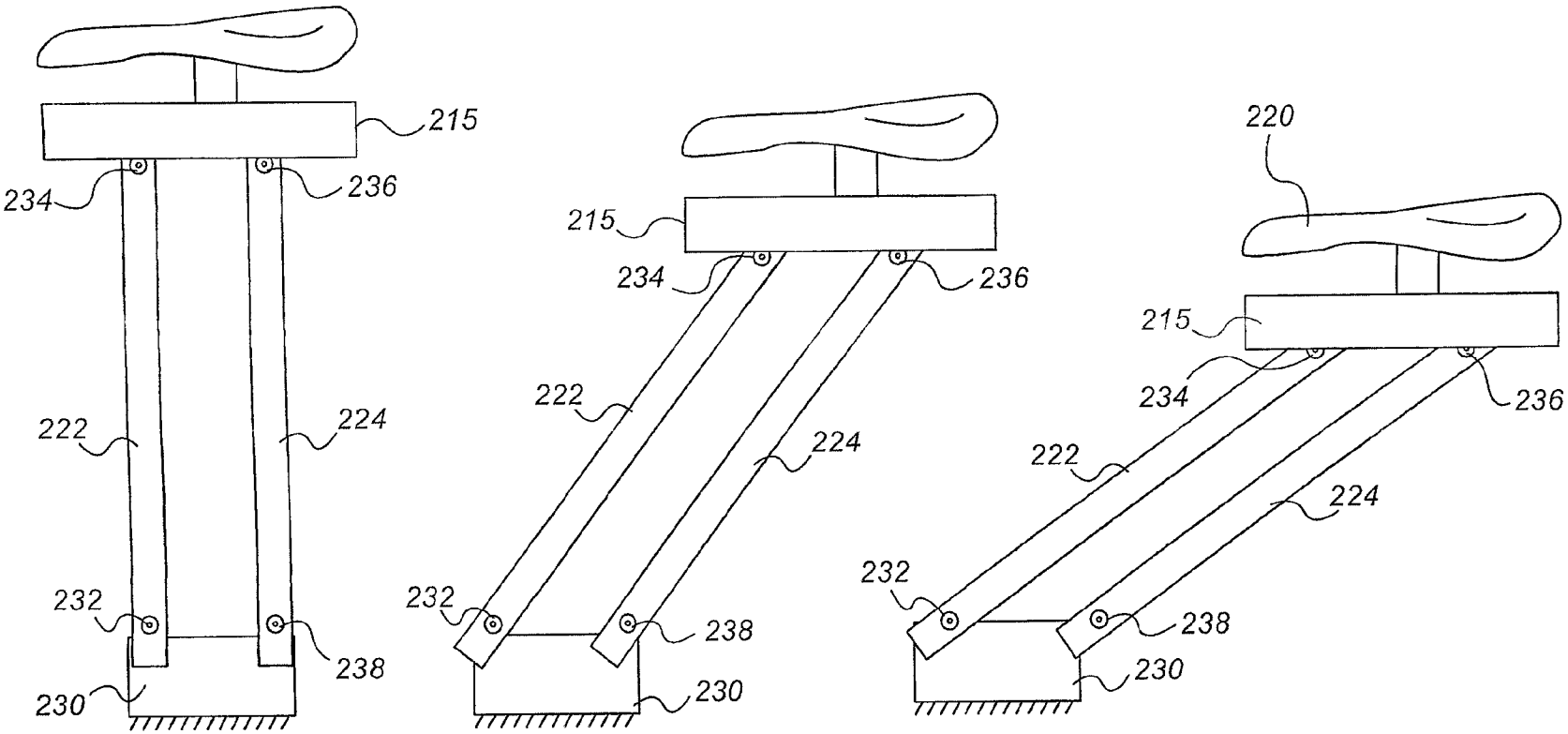
FIGS. 2A-2C show a mechanism that enables keeping the seat substantially parallel to the ground, In accordance with some exemplary embodiments of the disclosed subject matter.

FIG. 1B schematically illustrates stationary bicycle 100 enabled to operate as both upright and recumbent stationary bicycle using circular movement of the directing rod connected to the seat, in accordance with an exemplary embodiment of the disclosed subject matter. The movement of the directing rod 140 is generally circular, to keep the distance between the seat 130 and the wheel 120 generally constant, in either upright state and recumbent state. In some exemplary embodiments of the disclosed subject matter. the seat 130 is mounted on top of a rigid base 135. In such case, said rigid base 135 is connected to the directing rod 140. Rigid base 135 may be connected to the directing rod 140 via an adjustment element such as a pivot, as shown in FIGS. 2A-2C, to keep the seat 130 generally parallel to the ground (not shown) when the angle between the directing rod 140 and the ground changes. The user, using a pivot 134, may adjust the angle between the seat 130 and the directing rod 140. Said pivot 134 may be connected to the directing rod 140 or to the rigid base 135 on its lower end and to the seat 130 on its upper end. In accordance with some exemplary embodiments of the subject matter, a secondary pivot 125 connecting the directing rod 140 to the body 110 enables the generally circular movement of the directing rod 140. Alternatively, pivot 125 is mounted between two portions of the directing rod 140, such that only the upper portion of directing rod 140, the portion relatively close to the seat 130, is moved circularly.

FIGS. 2A to 2C show a mechanism that enables keeping a seat 220 substantially parallel to the ground 205. In accordance with some exemplary embodiments of the disclosed subject matter, seat 220 is mounted on or connected to base 215, connected to a body 230 of stationary bicycle (such as 100 of FIG. 1) via a pair of arms 222, 224. Arms 222,224 are connected on one end to the base 215, and on the other end to the body 230 or to another rigid element connected to the body 230. Arms 222, 224 may be connected via joints 232, 234, 236 and 238. For example, the joint 232 connects arm 222 and body 230. The joints 232, 234, 236 and 238 enable rotational movement of the arms, as seen by the change of the location of the seat 220 in FIG. 2A relative to FIG. 2C. In FIG. 2A, the seat 220 is located substantially above the wheel (not shown) of the stationary bicycle (such as 100 of FIG. 1) as in upright bicycle, while in FIG. 2C the seat 220 is located behind the wheel (not shown), as in recumbent stationary bicycle.

Joint 234 connects the arm 222 to the base 215 on which the seat 220 is mounted or to which the seat 220 is connected. Similarly, the joint 236 connects arm 224 to base 215, and the joint 238 connects the arm 224 to the body 230. Joints 234 and 236 enable keeping the seat 220 parallel to the ground when the stationary bicycle is in upright position as shown in FIG. 2A and when the stationary bicycle is in recumbent position as shown in FIG. 2C. Keeping the seat parallel to the ground is achieved by maintaining a parallelogram form between the arms 222, 224, base 215 and the upper end of the body 230. In some exemplary embodiments of the disclosed subject matter, in upright bicycle device, the line between the seat and the pedals creates an angle in a range of 70-110 degrees from the ground. In recumbent bicycle device, the line between the seat and the pedals creates an angle in a range of 10-80 (100-170) degrees from the ground. A person skilled in the art may define other ranges of angles. A line between the seat and the wheel may alternatively define the angle.

The circular movement provided in the exemplary embodiment of the disclosed subject matter may enable the user to maneuver the seat to a range of 160 degrees. As such, the joints disclosed above may enable such range of movement, and allow both movement to forward and backward directions, for example towards the handlebars of the stationary bicycle device, or towards the rear wheel of the device.

Figure 3:
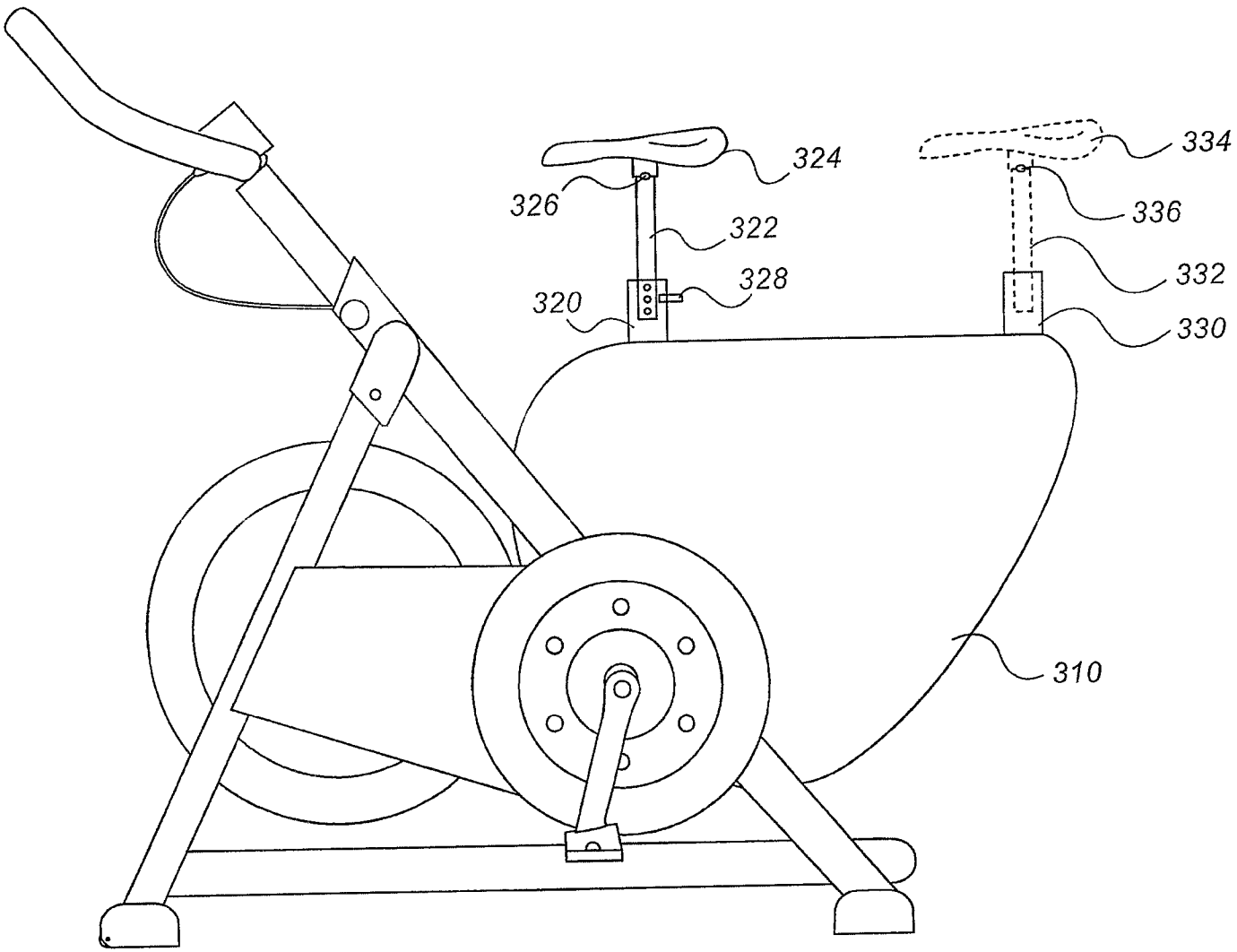
FIG. 3 shows a stationary bicycle having at least two bores in which an apparatus comprising a seat is to be inserted, according to some exemplary embodiments of the disclosed subject matter; and, FIG. 4 shows a circular movement of a directing rod and a seat, connected to a body of a stationary bicycle, according to some exemplary embodiments of the disclosed subject matter.

FIG. 3 shows a stationary bicycle having at least two bores in which an apparatus comprising a seat is to be inserted, according to some exemplary embodiments of the disclosed subject matter. Stationary bicycle 300 comprises a handlebar 350, a body 310 and a wheel 312. The user of the stationary bicycle 300 operates the wheel 312 using pedals (not shown). Stationary bicycle 300 comprises two or more bores 320, 330, into which a seat apparatus is to be inserted. The seat apparatus comprises a seat, such as seat 324, and a rod, such as rod 322, connected to the seat. One of the two or more bores 320, 330 is located substantially above the wheel 312 of the stationary bicycle 300. In FIG. 3, bore 320 is located substantially above the wheel 312 while bore 330 is located below the bore 320. As such, when positioning a seat mechanism on bore 320, the stationary bicycle 300 is used as upright bicycle, and positioning a seat mechanism on bore 330, results in using the stationary bicycle 300 as recumbent bicycle.

In some exemplary embodiments of the disclosed subject matter, the seat mechanism comprises both the seat and the directing rod. As such, the user can adjust the angle between the seat and the directing rod, and adjust the seat relative to the body of the stationary bicycle device. In some other exemplary embodiments, the seat mechanism is a one-piece molded mechanism, in which the rod is part of the seat, and cannot be removed or adjusted.

The bores 320, 330 may be polygonal or elliptical, and their height may be constant or adjustable. In many embodiments of the disclosed subject matter, the height of the rear bore, such as the bore 330, is lower than the height of the front bore, such as bore 320. The bores 320, 330 may be stable, to simplify the stationary bicycle, but may also me moved horizontally or vertically using a track or another movement mechanism.

The seat mechanism positioned into the bore 320 contains a directing rod 322 and a seat 324. An adjusting pin 328 may be inserted in a selected aperture in the bore 320 to adjust the height of the seat 324 and the distance between the seat 324 and the wheel 312. A joint 326 may be positioned between the seat 324 and the directing rod 322 to enable adjustment of the angle between the seat 324 and the directing rod 322. Alternatively, a seat mechanism may be positioned in bore 330. Such seat mechanism is generally equivalent to the seat mechanism positioned in the bore 320 and comprises a seat 334, a directing rod 332 and a joint 336.

Figure 4:
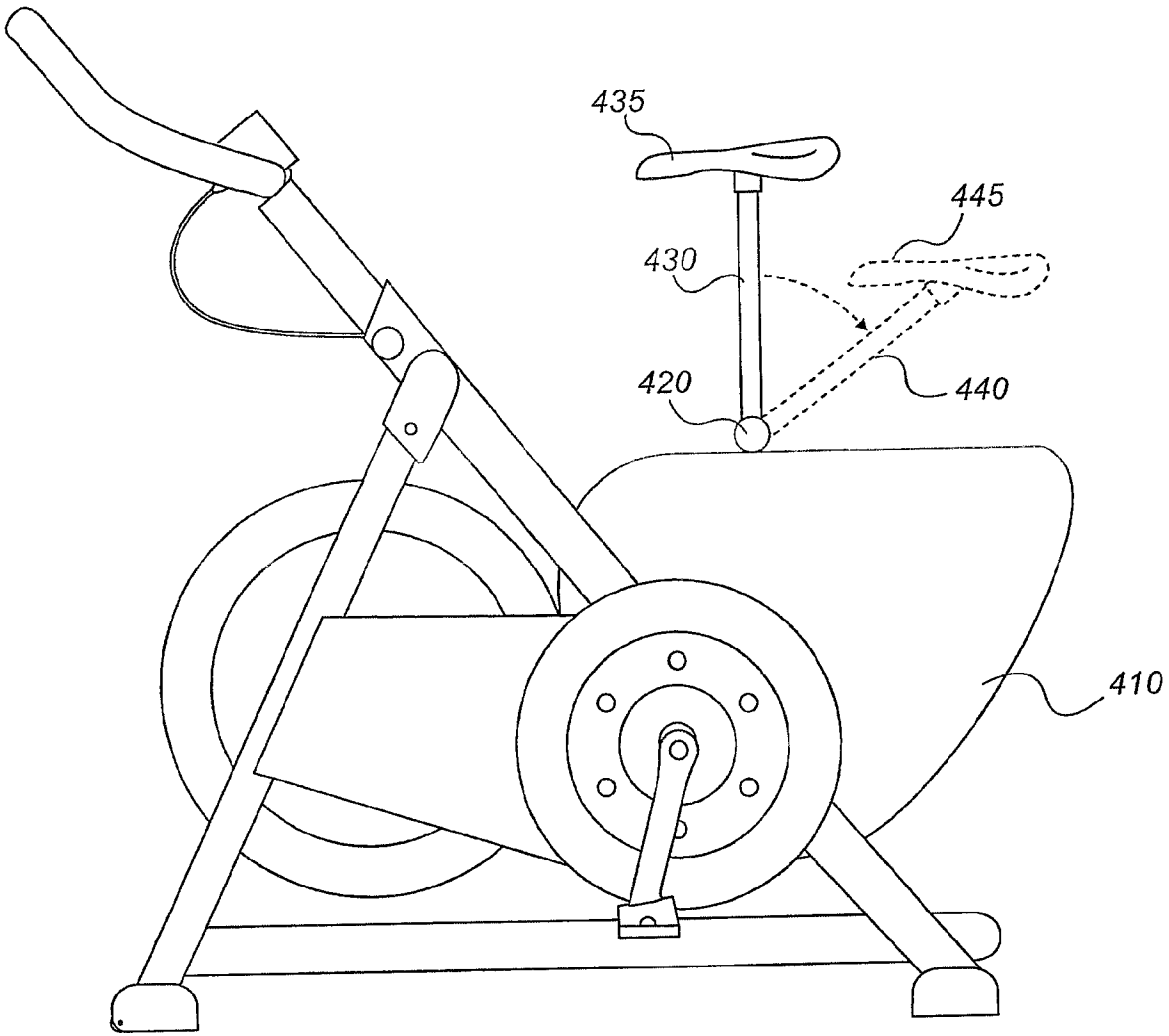

FIG. 4 shows a circular movement of a directing rod and a seat, connected to a body of a stationary bicycle, according to some exemplary embodiments of the disclosed subject matter. The body 410 of the stationary bicycle may be connected to the directing rod 430 via a joint 440. Seat 435 is positioned on top of the directing rod 430. In the embodiment disclosed in FIG. 4, there is no joint connecting the seat 435 and the directing rod 430, and the seat is parallel to the ground using the parallelogram shape of the legs assembling the directing rod 430, as shown in FIGS. 2A-2C. The seat 435 is located substantially above a wheel 412 used by the user of the stationary bicycle 400 as an upright bicycle device. When the directing rod 430 is maneuvered circularly and positioned in a rear position 440, the stationary bicycle is used as a recumbent bicycle device. The user of the stationary bicycle may perform maneuvering of the directing rod 430. Alternatively, such maneuver may be performed by a power engine (not shown) controlled by the user or by a control unit. Seat 445 shown in the rear position is the same as seat 435 of the front position. The position of seat 445 is used when the user operates the stationary bicycle 400 as a recumbent bicycle device.

The disclosed subject matter is likely to be used on stationary bicycle exercising devices. Nevertheless, the subject matter and the embodiments disclosed above may be used in any kind of bicycle, such as mountain bike or sports bike. The subject matter may also be used in motorcycles, scooters and the like.

One technical effect of the subject matter is to enable one exercising device to function as both recumbent stationary bicycle and as upright stationary bicycle. Another technical effect is the use of a pair of poles to maintain the seat parallel to the ground. Another technical effect is to keep the distance between the seat and the wheel substantially constant using a circular movement of the poles, in addition to linear movement which is implemented in another embodiment of the subject matter.

While the disclosure has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings without departing from the essential scope thereof. Therefore, it is intended that the disclosed subject matter not be limited to the particular embodiment disclosed as the best mode contemplated for carrying out this invention, but only by the claims that follow.

The invention claimed is:

1. A bicycle device comprising:

a body;

a pedal;

a wheel operated by a user of the exercising device by moving the pedal;

a movable directing rod connecting between the body and the seat;

wherein movement of the directing rod allows positioning the seat in a front position for using the bicycle as an upright bicycle and a rear position for using the bicycle as a recumbent mode;

wherein the proximal end of the directing rod is connected to the body in an area defined by the circumference of the pedal's movement to maintain the distance between the seat and pedal substantially constant, in the various locations of the seat.

2. The bicycle device of claim 1, wherein the seat is positioned substantially above the wheel when used as an upright bicycle and positioned substantially rearward of the wheel when used as a recumbent bicycle.

3. The bicycle device according to claim 1, wherein the movement of the directing rod is linear.

4. The bicycle device according to claim 3, further comprising a track for moving the directing rod.

5. The bicycle device according to claim 1, wherein the movement of the directing rod is circular.

6. The bicycle device according to claim 5, wherein the directing rod comprises two or more parallel longitudinal arms, such that the seat is generally parallel to the ground when used as a recumbent bicycle without adjusting the angle between the seat and the directing rod.

7. The bicycle device according to claim 6, comprising two or more joints connecting the two or more parallel longitudinal arms to the seat and to the body of the exercising device.

* * * * *